US009516912B2

(12) United States Patent
Mathis

(10) Patent No.: US 9,516,912 B2
(45) Date of Patent: Dec. 13, 2016

(54) SHOE WITH REMOVABLE MAGNETIC TOE CAP

(71) Applicant: ShaTona M. Mathis, Buffalo, NY (US)

(72) Inventor: ShaTona M. Mathis, Buffalo, NY (US)

( * ) Notice: Subject to any disclaimer, the term of this patent is extended or adjusted under 35 U.S.C. 154(b) by 192 days.

(21) Appl. No.: 13/870,735

(22) Filed: Apr. 25, 2013

(65) Prior Publication Data

US 2014/0317961 A1 Oct. 30, 2014

(51) Int. Cl.

| | |
|---|---|
| ***A43B 13/22*** | (2006.01) |
| ***A43B 23/08*** | (2006.01) |
| ***A43B 3/24*** | (2006.01) |
| ***A43B 1/00*** | (2006.01) |

(52) U.S. Cl.

CPC ..... *A43B 3/242* (2013.01); *A43B 1/0054* (2013.01); *A43B 23/082* (2013.01)

(58) Field of Classification Search

CPC ..... A43B 3/24; A43B 3/242; A43B 3/103; A43B 3/244; A43B 3/246; A43B 1/0054; A43B 13/16; A43B 23/081; A43B 23/082; A43B 23/083; A43C 13/02; A43C 13/12; A43C 13/14

USPC ..... 36/43–45, 71.5, 72 R, 77 R, 77 M, 100,36/101, 132, 136; 2/245

See application file for complete search history.

(56) References Cited

U.S. PATENT DOCUMENTS

| | | | | |
|---|---|---|---|---|
| 854,274 | A | 5/1907 | Schwartz | |
| 1,890,433 | A * | 12/1932 | Cohen | A43B 7/06 36/3 A |
| 2,235,490 | A | 3/1941 | Saksa | |
| 2,261,125 | A | 11/1941 | McFeely | |
| 2,268,435 | A * | 12/1941 | Zucker | 36/7.5 |
| 2,292,297 | A * | 8/1942 | Sherlock | A43B 23/081 2/239 |
| 2,325,741 | A * | 8/1943 | Chertok | A43B 5/12 36/1 |
| 2,327,043 | A | 8/1943 | Hirsch | |
| 2,345,187 | A | 3/1944 | Evans | |
| 2,419,390 | A | 4/1947 | Chertok | |
| 2,723,469 | A * | 11/1955 | Shusterman | 36/72 R |
| 2,873,540 | A | 2/1959 | Murphy | |
| 3,487,830 | A | 1/1970 | Pruett | |
| 3,548,521 | A | 12/1970 | Sachs | |
| 3,686,779 | A | 8/1972 | Sachs | |
| 4,061,138 | A | 12/1977 | Bernstein | |

(Continued)

OTHER PUBLICATIONS

TheFreeDictionary.com—definition of "circumscribe".*

*Primary Examiner* — Anna Kinsaul
*Assistant Examiner* — Jameson Collier
(74) *Attorney, Agent, or Firm* — Simpson & Simpson, PLLC

(57) ABSTRACT

A shoe having a magnetically removable toe cap, where the shoe includes an upper, a heel secured to the upper, a sole secured to the upper, the sole having an outsole and a support fixedly secured to the outsole, the upper comprising a vamp secured to the sole in such a way as to form an open toe section, the shoe also comprising a magnet hidden and secured within the vamp; and, a metal toe cap having a lower flange portion and an upper portion, the toe cap arranged to be magnetically attracted to the magnet hidden within the vamp, and to lock in place with the shoe, where the lower flange portion contacts and circumscribes the outsole, and the upper portion contacts and circumscribes the vamp when the toe cap is magnetically secured to the shoe.

6 Claims, 8 Drawing Sheets

(56) References Cited

U.S. PATENT DOCUMENTS

| | | | | |
|---|---|---|---|---|
| 4,454,872 | A | 6/1984 | Brouhard | |
| 4,638,574 | A * | 1/1987 | Roda | 36/7.2 |
| 4,780,970 | A * | 11/1988 | McArthur et al. | 36/72 R |
| D308,903 | S * | 7/1990 | Rosas | D2/913 |
| 4,995,174 | A * | 2/1991 | Hong et al. | 36/72 R |
| 5,060,400 | A | 10/1991 | Finn et al. | |
| 5,339,543 | A | 8/1994 | Lin | |
| D391,744 | S | 3/1998 | McMaster | |
| 5,946,823 | A | 9/1999 | Yates | |
| 6,131,312 | A * | 10/2000 | Hung | 36/77 R |
| 6,286,234 | B1 * | 9/2001 | Smith, Jr. | 36/131 |
| 6,311,415 | B1 * | 11/2001 | Lind | A43B 5/00 36/130 |
| 6,581,255 | B2 | 6/2003 | Kay | |
| 6,836,980 | B2 | 1/2005 | Woods | |
| 6,898,873 | B2 | 5/2005 | Schenone | |
| 7,127,837 | B2 | 10/2006 | Ito | |
| 7,219,445 | B2 * | 5/2007 | Stern et al. | 36/11.5 |
| 7,421,807 | B2 | 9/2008 | Condie | |
| 7,661,206 | B2 | 2/2010 | Osborn | |
| 7,698,834 | B1 * | 4/2010 | Courville | 36/15 |
| 7,730,634 | B2 | 6/2010 | LaDuca | |
| 7,802,381 | B2 | 9/2010 | Condie | |
| 7,854,075 | B2 * | 12/2010 | Kosmas | 36/44 |
| 8,015,731 | B2 | 9/2011 | Jackson | |
| 2002/0069558 | A1 * | 6/2002 | Wilkinson | A43B 23/081 36/106 |
| 2003/0213149 | A1 | 11/2003 | Woods | |
| 2003/0233772 | A1 | 12/2003 | Musial | |
| 2004/0118019 | A1 | 6/2004 | Ito | |
| 2005/0126045 | A1 | 6/2005 | Guidry | |
| 2007/0068045 | A1 | 3/2007 | Condie | |
| 2007/0130802 | A1 | 6/2007 | Condie | |
| 2007/0214681 | A1 | 9/2007 | Dezfouli | |
| 2008/0098623 | A1 | 5/2008 | Komitau | |
| 2008/0229612 | A1 * | 9/2008 | Sommer | A43B 1/0045 36/44 |
| 2008/0235993 | A1 | 10/2008 | Wegner | |
| 2008/0301978 | A1 | 12/2008 | Colella | |
| 2009/0013555 | A1 * | 1/2009 | Vitulli | A43B 7/12 36/10 |
| 2009/0165335 | A1 | 7/2009 | Jackson | |
| 2009/0229145 | A1 * | 9/2009 | Ortner | 36/100 |
| 2010/0000126 | A1 | 1/2010 | Ortner | |
| 2011/0088284 | A1 | 4/2011 | Wruck et al. | |
| 2012/0260530 | A1 | 10/2012 | Policastro | |
| 2013/0185958 | A1 * | 7/2013 | McGuire | 36/101 |

* cited by examiner

SHOE WITH REMOVABLE MAGNETIC TOE CAP

FIELD OF THE INVENTION

The invention relates generally to shoes, and more specifically to a shoe with a removable magnetic toe cap. Even more specifically, the present invention relates to a magnetic toe cap for an open-toe shoe, also known as a peep toe shoe. According to Wikipedia, "A peep toe shoe is a woman's shoe (usually a pump, slingback, bootie, or any other dress shoe) in which there is an opening at the toe-box which allows the toes to show."

BACKGROUND OF THE INVENTION

Almost everyone wears shoes, and many varieties and types of shoes are well known. The present invention relates generally to a certain type of shoe, known as an open-toe or peep toe shoe. As the name suggests, in an open-toe shoe, part of the vamp section of the shoe (which, in turn, is part of the upper section of the shoe) is cut away to expose the toes of the wearer. In an open-toe shoe, which is perhaps most popular with women and girls, the toes of the wearer are exposed through the vamp, but rest upon an extended part of the inlay (which, in turn, is secured to the insole.)

While open-toe shoes are comfortable and popular in warm weather, the toes' exposure to the elements makes them an unpopular choice in winter and in rainy or cold weather. In any area of the world where winters are cold, rainy or snowy, many owners of open-toe shoes simply store them away for the season, or carry them in totes to their indoor destination. In short, bad weather tends to render open-toe shoes impractical for at least part of the year.

Another problem with open-toe shoes is experienced by many women, and some men, who enjoy pedicures. Pedicures almost always culminate in the application of paint or polish, which usually takes time to dry. Walking in open-toe shoes after receiving a pedicure exposes the polish/paint to damage such as smearing, streaking or scratching.

The pedicure problem associated with open-toe shoes has been noticed by Melissa Condie of St. Louis, Mo. She purports to solve the problem with footwear for use during or after a pedicure and a method of using the same, as described in U.S. Pat. No. 7,421,807 and U.S. Pat. No. 7,802,381. While Ms. Condie's patented invention arguably solves the problem toe nails not contacting the upper portion of the shoe after a pedicure, the resulting shape of the shoe was made concave to achieve this goal, which may not be preferred by all wearers. Also, the toe cover in this patented invention rests atop the shoe, with fastening means on the side of the cover. The cover does not form a seal under the sole, which means that water and the like can seep into the shoe between the cover and the sides of the shoe.

Therefore, there has been a long-felt need for a shoe with a removable magnetic toe cap which converts an open toe shoe into a closed toe shoe and, while in place, seals the toe section of the shoe from the elements.

BRIEF SUMMARY OF THE INVENTION

The present invention broadly comprises a shoe with a removable magnetic toe cap. In one embodiment, the invention broadly comprises a shoe having a magnetically removable toe cap, where the shoe includes an upper, a heel secured to the upper, a sole secured to the upper, the sole having an outsole and a support fixedly secured to the outsole, the upper comprising a vamp secured to the sole in such a way as to form an open toe section, the shoe also comprising a magnet hidden and secured within the vamp; and, a metal toe cap having a lower flange portion and an upper portion, the toe cap arranged to be magnetically attracted to the magnet hidden within the vamp, and to lock in place with the shoe, where the lower flange portion contacts and circumscribes the outsole, and the upper portion contacts and circumscribes the vamp when the toe cap is magnetically secured to the shoe.

In a second embodiment, the invention broadly comprises a shoe having a magnetically removable toe cap, where the shoe includes an upper, a heel secured to the upper, a sole secured to the upper, the sole having an outsole and a support fixedly secured to the outsole, the upper comprising a vamp secured to the sole in such a way as to form an open toe section, the shoe also comprising a metal member secured within the vamp; and, a magnetic toe cap having a lower flange portion and an upper portion, the toe cap arranged to be magnetically attracted to the metal hidden within the vamp, and to lock in place with the shoe, where the flange portion contacts and circumscribes the outsole, and the upper portion contacts and circumscribes the vamp when the toe cap is magnetically secured to the shoe.

A general object of the present invention is to provide a magnetic toe cap which functions to convert an open toe shoe into a closed toe shoe.

Another object of the present invention is to provide a toe cap which magnetically attaches to an open toe shoe and seals the toe section of the shoe by covering part of the sole to prevent water from entering between the sole and the toe cap.

A further object of the present invention is to provide a magnetic toe cap of a first color which is substantially similar to the color of an inlay which rests atop the insole of the shoe.

These and other objects, advantages and features of the present invention will be better appreciated by those having ordinary skill in the art in view of the following detailed description of the invention in view of the drawings.

BRIEF DESCRIPTION OF THE DRAWINGS

Further advantages and advantageous embodiments of the invention will become apparent from the Figures listed below and their descriptions.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Figure 1:
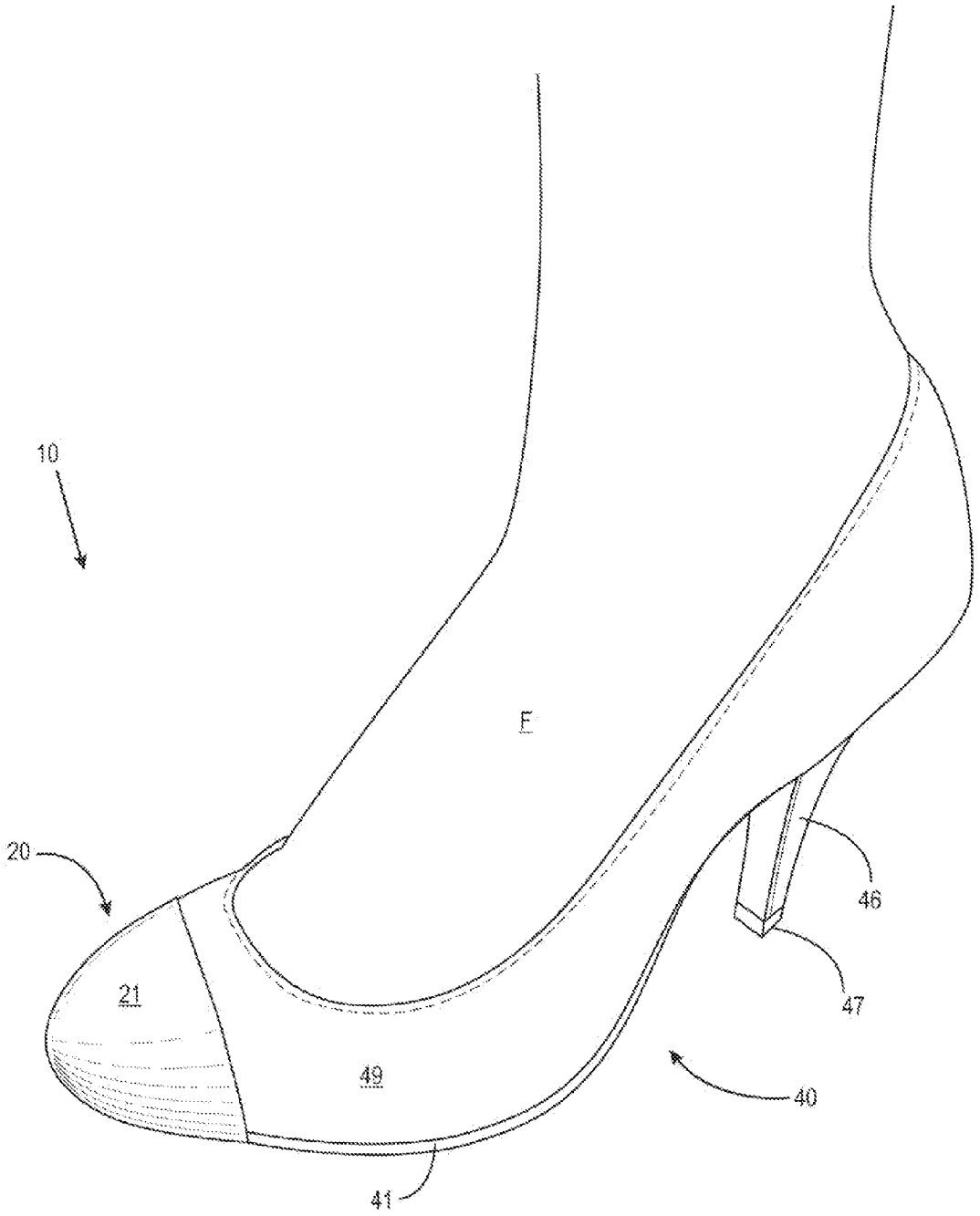
FIG. 1 is a perspective view of a preferred embodiment of the invention.

It should be understood that the terms "right", "left", "front", "rear", "top" and "bottom" refer to the perspective of one viewing the embodiment of the invention shown in FIG. 1.

Finally, it should be understood that the description that follows incorporates various words to describe the anatomy of the shoe of the invention. These words/terms are well known in the art, and are further defined as follows:

Heel: The heel is the part of the sole (outsole) that raises the rear of the shoe in relation to the front. The part of the heel that comes in contact with the ground is known as the top piece. In a "high-heel" shoe as shown in the drawings, a top lift is fixedly secured to the heel, and the top lift comes in contact with the ground.

Insole: The insole is a layer of material that sits inside the shoe and creates a layer between the sole and the wearer's foot. The insole adds comfort for the wearer, while hiding the joint between the sole and the upper.

Toe Cap: The toe cap of the present invention is a cover that is magnetically, removably secured at the front of the shoe, and converts the open-toe or peep-toe shoe of the present invention into a closed-toe shoe.

Outsole: The outsole is the exposed part of the sole that is in contact with the ground.

Inlay: The inlay is placed on top of the insole and is removable. It is the part of the shoe that the wearer's foot contacts directly. Insoles are glued, stapled or sewn into place in a shoe, whereas inlays are removable.

Vamp: The vamp is that portion of the shoe that covers the toes and a portion of the instep. In open-toe shoes, the vamp is cut to expose the toes of the wearer.

Upper: The upper is that portion of the shoe that covers the top of the foot. It includes the vamp and quarter.

Quarter: The quarter is the rear and sides of the upper that covers the heel at the rear of the vamp. Some shoe designs use a continuous piece of leather for the vamp and quarter.

Top Lift: In a high heel shoe, the top lift is fixedly secured to the bottom of the heel. It is the part of the shoe that contacts the ground.

Outsole Support: The outsole support is a member fixedly secured to the bottom of the outsole. The outsole support lifts the shoe off the ground and the bottom of the outsole support contacts the ground.

Adverting now to the drawings, FIG. 1 illustrates shoe with removable toe cap 10, which broadly includes toe cap 20 and shoe 40. Shoe 40 is shown in place on left foot F of a person. Shoe 40 is shown to broadly include vamp 49, outsole 41, heel 46 and top lift 47.

Figure 2:
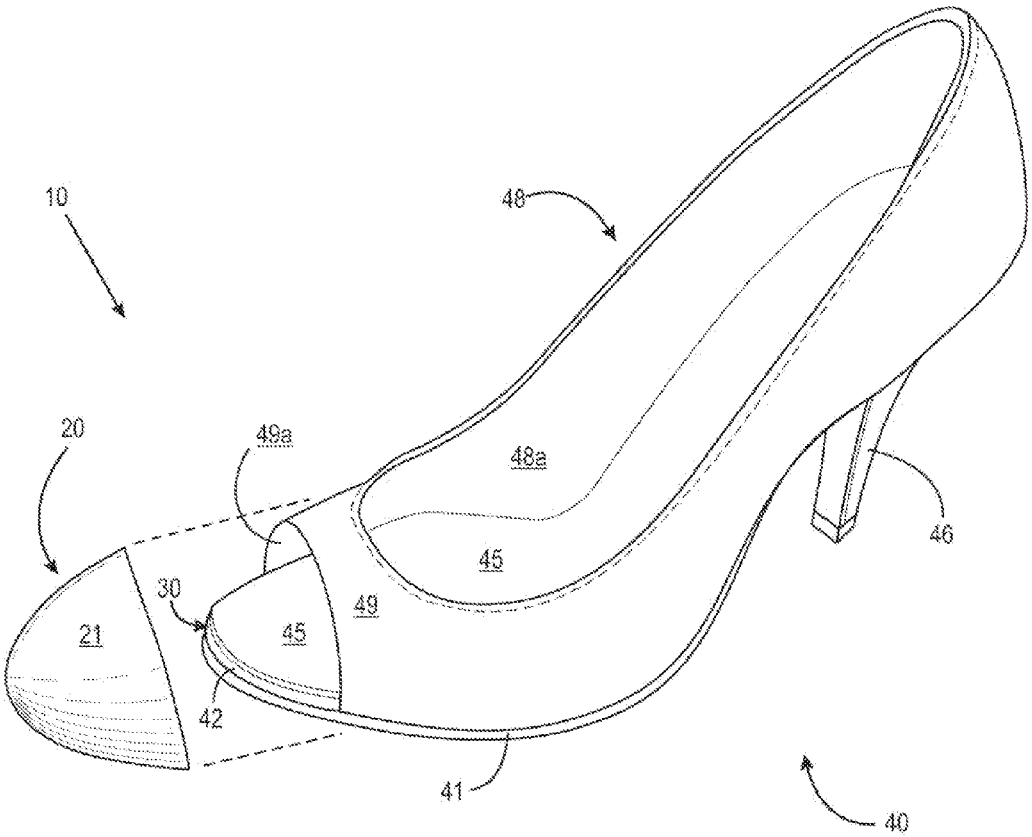
FIG. 2 is a partially exploded perspective view of the embodiment shown in FIG. 1, showing the toe cap removed from the shoe.

FIG. 2 is a partially exploded perspective view of the shoe shown in FIG. 1, but with toe cap 20 removed to show open toe shoe 40. This view illustrates how vamp 49 is cut to form an "open toe" or "peep toe" shoe. This view also shows upper inner surface 48*a*, vamp inner surface 49*a*, insole 42, and inlay 45. The drawing shows toe cap 20 removed from shoe 40. In a preferred embodiment, the color of outer surface 21 of toe cap 20 is the same as the color of inlay 45. For example, in a preferred embodiment, toe cap 20 is made of metal and is silver in color, and inlay 45 is silver in color to match. Partially shown in FIG. 2 is embedded magnet 30 which functions to attract metal toe cap 20 and lock it in place on the shoe.

Figure 3:
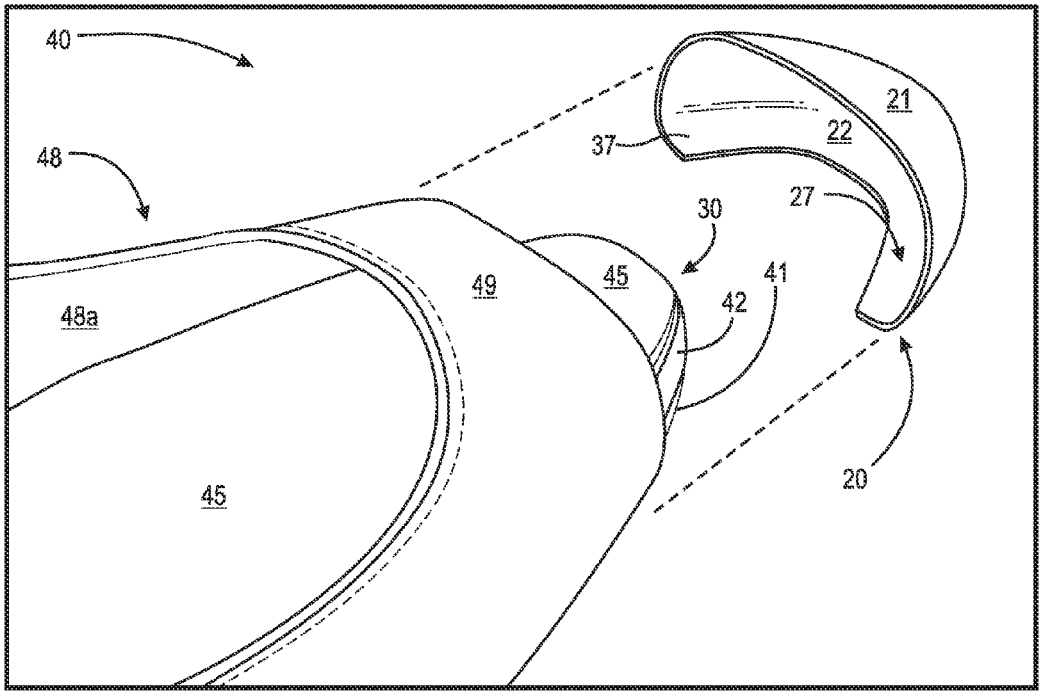
FIG. 3 is a fragmentary enlarged view of the invention, showing the general shape and structure of the toe cap.

FIG. 3 is an enlarged fragmentary exploded perspective view of the shoe and toe cap combination taken from the rear of the shoe, looking into the toe cap. This view shows inner surface 22 of toe cap 20 and also shows sealing flange 27 of toe cap 20.

Figure 4A:
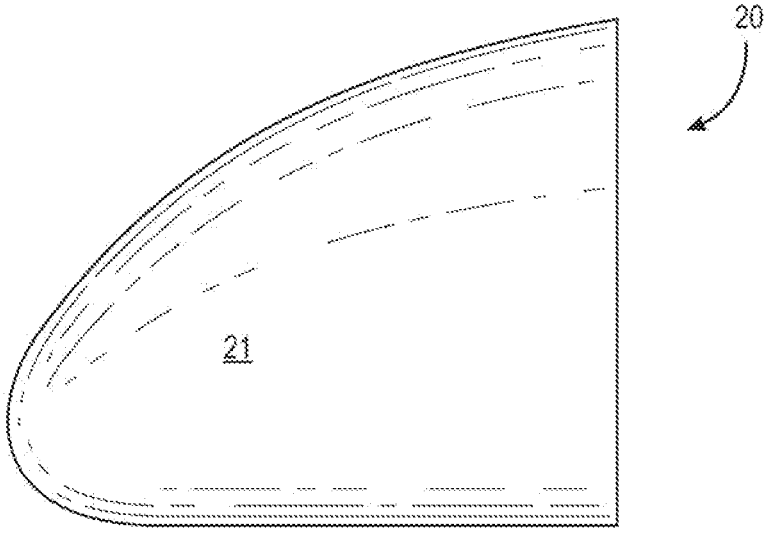
FIG. 4*a* is a front view of the toe cap of the invention, taken from the perspective of one viewing the shoe in FIG. 1.
Figure 4B:
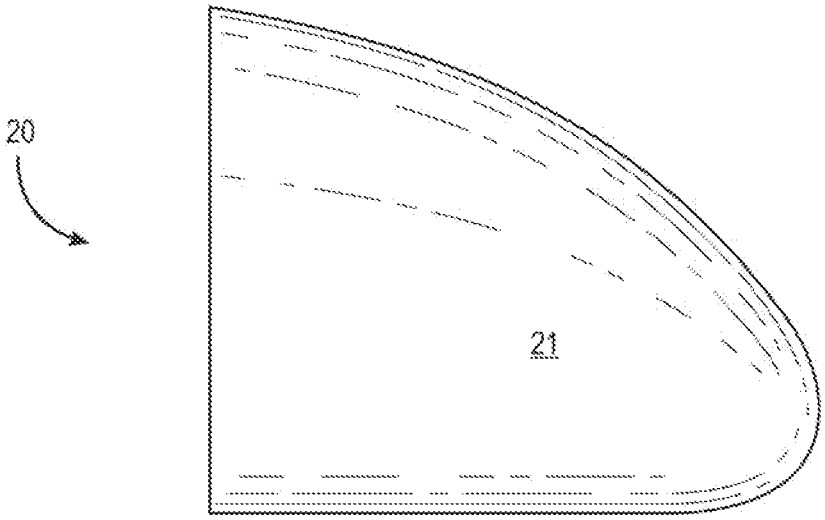
FIG. 4*b* is a rear view of the toe cap of the invention, taken from the perspective of one viewing the shoe in FIG. 1.

FIG. 4*a* is a front view of toe cap 20, and FIG. 4*b* is a rear view of toe cap 20.

Figure 5A:
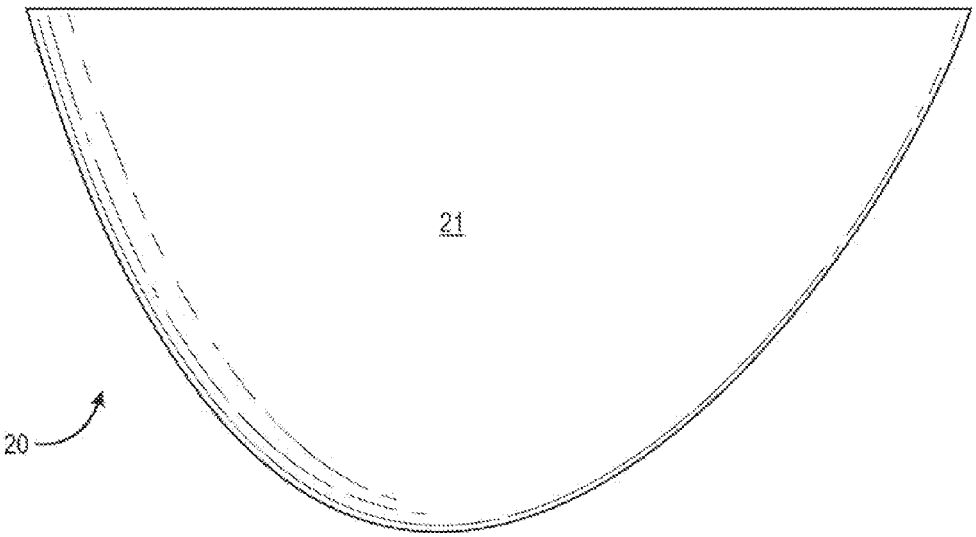
FIG. 5*a* is a top view of the toe cap of the invention, taken from the perspective of one viewing the shoe in FIG. 1.
Figure 5B:
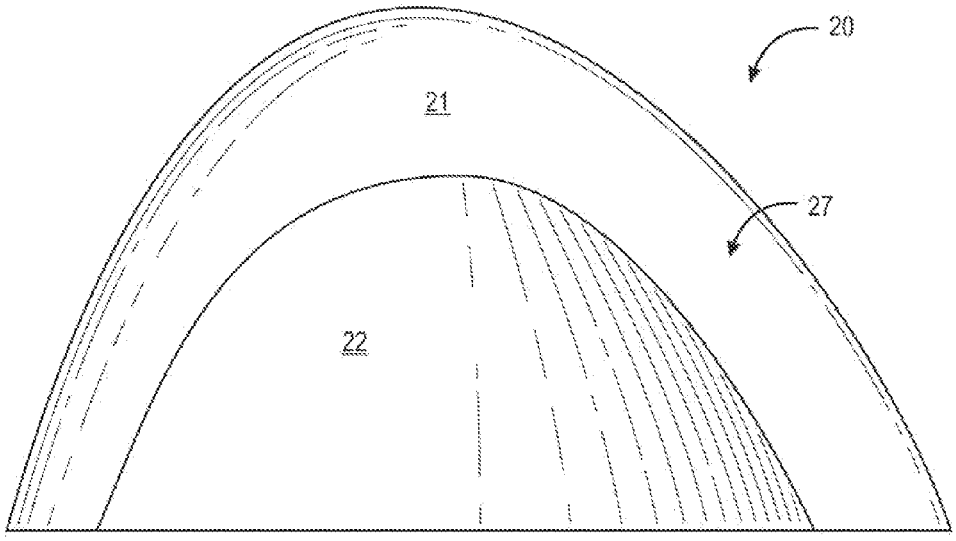
FIG. 5*b* is a bottom view of the toe cap of the invention, taken from the perspective of one viewing the shoe in FIG. 1.

FIG. 5*a* is a top view of toe cap 20, and FIG. 5*b* is a bottom view of toe cap 20. The top view shows outer surface 21. The bottom view shows outer surface 21, inner surface 22 and sealing flange 27 of toe cap 20.

Figure 6A:
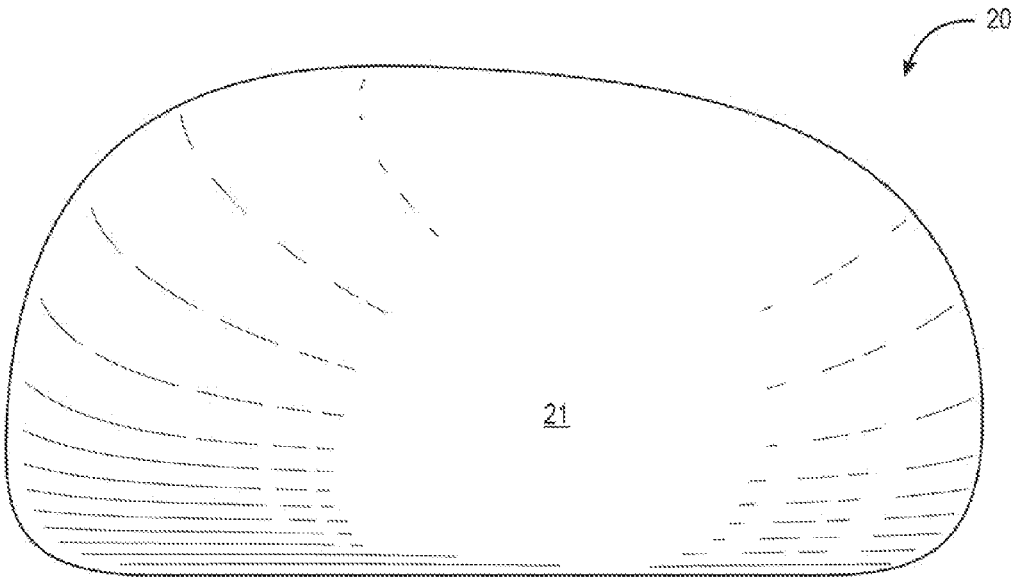
FIG. 6*a* is a left view of the toe cap of the invention, taken from the perspective of one viewing the shoe in FIG. 1.
Figure 6B:
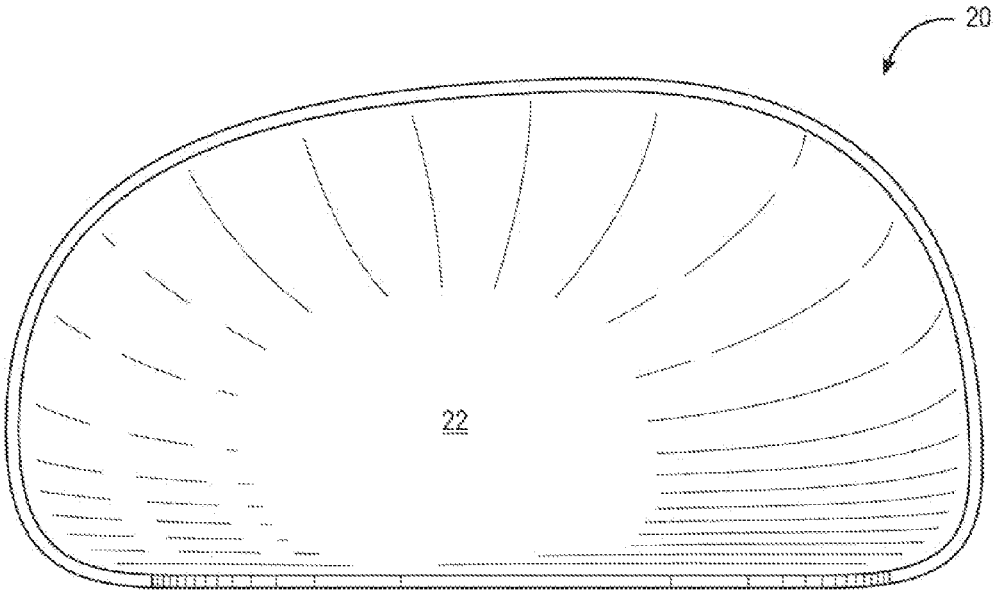
FIG. 6*b* is a right view of the toe cap of the invention, taken from the perspective of one viewing the shoe in FIG. 1.

FIG. 6*a* is a front view of toe cap 20 showing outer surface 21, and FIG. 6*b* is a rear view of toe cap 20 showing inner surface 22.

Figure 7:
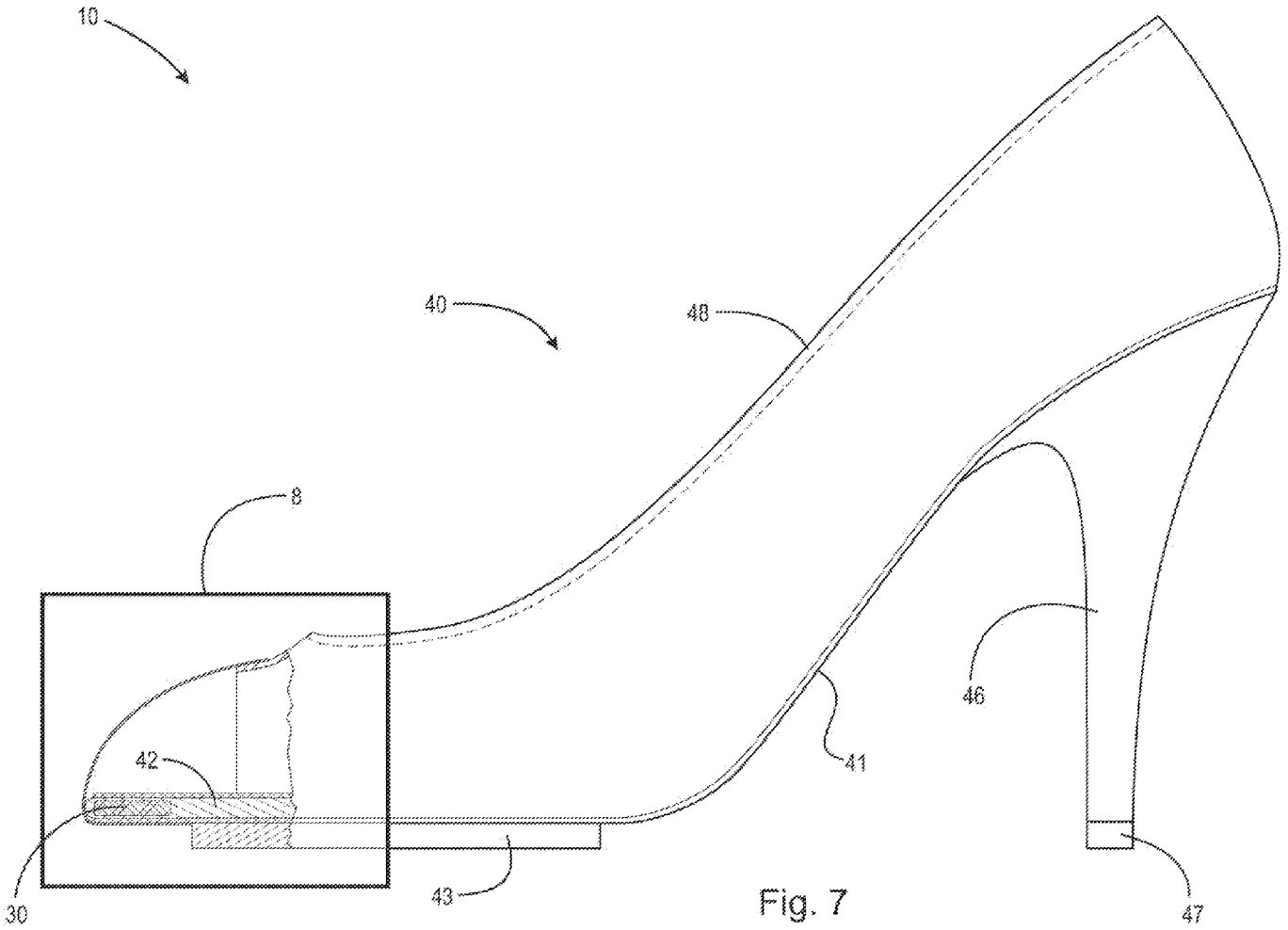
FIG. 7 is a front, partial cross-sectional view of the shoe shown in FIG. 1; and, FIG. 8 is an enlarged view of Section 8 of the shoe/toe cap assembly shown in FIG. 7.

FIG. 7 is a front, partial cross-sectional view of shoe 40, with part of the shoe and part of the toe cap cut away to show the sealing arrangement of the toe cap and shoe, and to illustrate placement of magnet 30 within insole 42.

Figure 8:
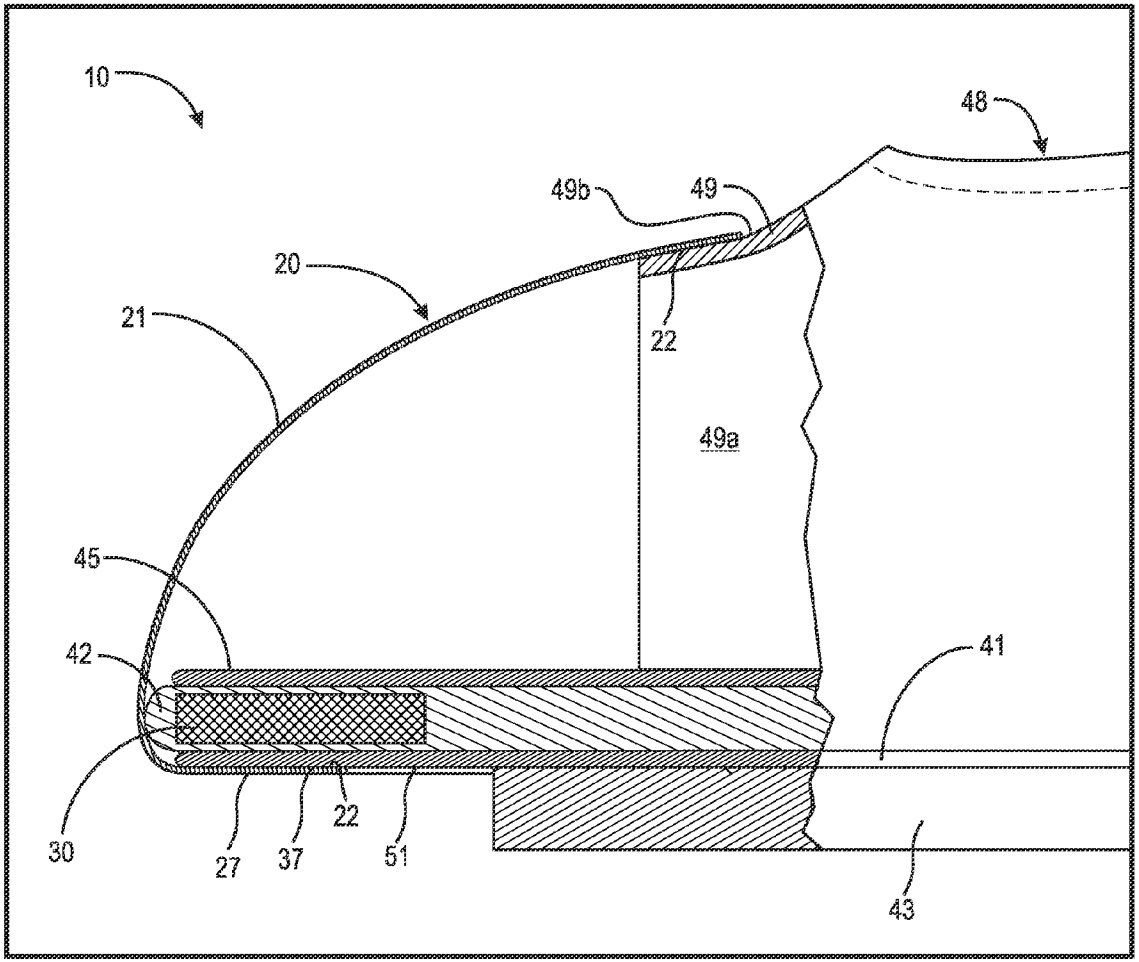

FIG. 8 is an enlarged view of section 8 shown in FIG. 7. As shown in this view, in a preferred embodiment, permanent magnet 30 is embedded in insole 42 of shoe 40, proximate the toe of the shoe. Toe cap 20 is preferably made of metal and is held securely to the shoe by the magnet. Importantly, when the toe cap is in place, inner surface 37 of flange 27 contacts outer surface 51 of outsole 41, thereby creating a seal to keep water and the elements out of the shoe. This sealing configuration is accommodated by the presence of outsole support 43 which is fixedly secured to outsole 41. This support lifts the outsole off the ground proximate the toe end of the shoe and avoids contact of the toe cap with the ground. As is evident in the various figures, in a preferred embodiment, a front end of outsole 41 proximate to the toe end of shoe 40 extends forwardly and past a front end of outsole support 43. It should be appreciated that in order for toe cap 20 to create a seal with outsole 41, toe cap 20 contacts a portion of outer surface 51 of outsole 41. Thus, outsole support 43 does not span the entire length of outsole 41 or it would interfere with the seal. The sealing effect is also seen at the top of this drawing figure, where inner surface 22 of toe cap 20 in shown to be in sealing contact with outer surface 49*b* of vamp 49. The magnet may be embedded in the insole in any number of ways. For example, an aperture can be cut into the insole from above, the magnet glued in place within the aperture, and then covered by the inlay. It should also be appreciated that the magnet and metal may be reversed, i.e., the toe cap may be magnetized and a metal member may be embedded in the insole (and also in the upper part of vamp 49, with the same magnetic attraction effect.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention as claimed.

PARTS LIST

F foot
10 shoe with magnetic removable toe cap
20 toe cap
21 toe cap outer surface
22 toe cap inner surface
30 embedded magnet
40 open-toe shoe
41 outsole
42 insole
43 outsole support
45 inlay
46 heel
47 top lift
48 upper
48*a* inside surface of upper
49 vamp
49*a* inside surface of vamp

What is claimed is:

1. A shoe having a magnetically removable toe cap, comprising:

a shoe comprising an upper, a heel, a sole secured to said upper, said sole having an outsole and an outsole support fixedly secured to said outsole, wherein a front end of said outsole proximate to a toe end of said shoe extends forwardly and past a front end of said outsole support, said outsole comprising an inner surface and an outer surface, said heel is directly secured to said outer surface of said outsole, said upper comprising a vamp secured to said sole in such a way as to form an open toe section wherein a front edge of said upper terminates rearwardly from the front end of the outsole, said shoe also comprising a magnet hidden and secured within said sole; and, a magnetic metal toe cap having a lower flange portion and an upper portion, said magnetic metal toe cap arranged to be magnetically attracted to said magnet hidden within said sole, and to lock in place with said shoe, where said lower flange portion contacts and partially encircles said outer surface of said outsole, and said upper portion contacts and partially encircles said vamp when said magnetic metal toe cap is magnetically secured to said shoe.

2. The shoe having a magnetically removable toe cap recited in claim 1 wherein said lower flange portion has a thickness which is less than a thickness of said outsole support.

3. The shoe having a magnetically removable toe cap recited in claim 1 wherein said shoe further comprises an insole, and an inlay positioned atop said insole, wherein said magnetic metal toe cap and said inlay are similar in color.

4. A shoe having a magnetically removable toe cap, comprising:

a shoe comprising an upper, a heel, a sole secured to said upper, said sole having an outsole and an outsole support fixedly secured to said outsole, wherein a front end of said outsole proximate to a toe end of said shoe extends forwardly and past a front end of said outsole support, said outsole comprising an inner surface and an outer surface, said heel is directly secured to said outer surface of said outsole, said upper comprising a vamp secured to said sole in such a way as to form an open toe section wherein a front edge of said upper terminates rearwardly from the front end of the outsole, said shoe also comprising a magnetic metal member hidden and secured within said sole; and, a magnetic toe cap having a lower flange portion and an upper portion, said magnetic toe cap arranged to be magnetically attracted to said magnetic metal member hidden within said sole, and to lock in place with said shoe, where said flange portion contacts and partially encircles said outer surface of said outsole, and said upper portion contacts and partially encircles said vamp when said magnetic toe cap is magnetically secured to said shoe.

5. The shoe having a magnetically removable toe cap recited in claim 4 wherein said lower flange portion has a thickness which is less than a thickness of said outsole support.

6. The shoe having a magnetically removable toe cap recited in claim 4 wherein said shoe further comprises an insole, and an inlay positioned atop said insole, wherein said magnetic toe cap and said inlay are similar in color.

* * * * *